United States Patent [19]

Pekar et al.

[11] Patent Number: 4,737,385

[45] Date of Patent: Apr. 12, 1988

[54] COATING COMPOSITION AND METHOD OF APPLICATION FOR IMPROVED CORROSION RESISTANCE OF METAL PARTS

[75] Inventors: Howard G. Pekar, Columbus; Edmund W. Kinkelaar, Dublin, both of Ohio

[73] Assignee: Texo Corporation, Cincinnati, Ohio

[21] Appl. No.: 815,637

[22] Filed: Jan. 2, 1986

[51] Int. Cl.[4] ..... B05D 7/14; B05D 3/02; B05D 5/00

[52] U.S. Cl. ..... 427/385.5; 427/386; 427/387; 427/388.5; 524/310; 524/313; 524/481

[58] Field of Search ..... 524/310, 313, 481, 482, 524/483, 484, 485, 486, 490, 491; 427/388.5, 386, 387, 385.5

[56] References Cited

U.S. PATENT DOCUMENTS

| | | | |
|---|---|---|---|
| 3,033,808 | 5/1962 | Murray | 524/313 |
| 3,135,712 | 6/1964 | Neuhaus | 524/313 |
| 3,214,398 | 10/1965 | Vannoy | 524/313 |
| 3,404,111 | 10/1968 | McNay | 524/484 |
| 3,438,920 | 4/1969 | Halper | 524/484 |
| 3,669,728 | 6/1972 | Seiner | 524/294 |
| 3,808,163 | 4/1974 | Wright | 524/310 |
| 4,386,180 | 5/1983 | Lat | 524/313 |

*Primary Examiner*—Paul R. Michl
*Assistant Examiner*—Mark R. Buscher
*Attorney, Agent, or Firm*—Francis T. Kremblas, Jr.

[57] ABSTRACT

A new method and formulation for treating metal parts for corrosion resistance is disclosed wherein both a paint coat and an oil coating formulation are simultaneously applied in a single step to the parts after the parts have been conventionally phosphated. The novel formulation disclosed is a di-phase composition wherein a distinct paint phase and an oil phase are present. The formulation is applied to the parts only when the two phases have been intimately dispersed to form a temporary suspension. Upon drying, the treated part is provided with a paint undercoat covered by an oil coating and exhibits significantly improved corrosion resistance as measured by standard salt spray corrosion tests.

9 Claims, No Drawings

COATING COMPOSITION AND METHOD OF APPLICATION FOR IMPROVED CORROSION RESISTANCE OF METAL PARTS

BACKGROUND OF INVENTION

The present invention relates generally to coating formulations and methods of application of the same for rendering metallic parts corrosion resistant. Specifically, the present invention relates to a novel method and coating composition wherein a two-phase formulation containing a separate paint phase and a separate oil phase are simultaneously applied to the metal part in one step to provide improved resistance to corrosion.

Prior to the present invention, the conventional corrosion resistance treatment consisted of the steps of a conventional and well-known phosphating treatment of the metal part, followed by a painting step to apply a paint coating. After appropriate baking or drying of the paint coat, the metal part is immersed in an oil formulation to apply a coat of oil over the paint undercoat. Such treated metal parts must meet certain industry standards, such as set by the automotive industry for example, relating to corrosion resistance in salt spray, tests to be suitable for use.

The standard test generally employed in a salt spray corrosion test is ASTM Method B 117 wherein the treated metal part is exposed to a salt spray atmoshpere for a predetermined time. Metal parts treated in the prior art manner have shown reasonably acceptable degrees of corrosion resistance pursuant to industry standard salt spray tests, although in many instances two coats of paint followed by a coat of oil are required to assure the metal parts satisfactorily meet the minimum requirements.

U.S. Pat. No. 4,165,242 discloses a general description of prior art processes for treating phosphated metal parts to improve corrosion resistance utilizing the general steps of applying a paint coat and then an oil coat in separate steps and includes descriptions of some of the paint and oil formulations useful in such processes as is well-known to those skilled in the art.

However, prior to the present invention, there has been no formulation or method which consistently provides salt spray corrosion resistance equal to or exceeding automotive industry standards for painted parts without employing both a paint coating and a separate oil coating step.

Prior attempts to use an oil coupled into the paint vehicle gave limited corrosion resistance which did not acceptably meet industry standards. Therefore, prior to the present invention, the conventional paint undercoat and oil overcoat were applied in either a two or three step process.

The three step process referred to above involves a process wherein a large number of small parts are treated in a batch method. Two separate painting steps are employed wherein a first paint coat is applied to the parts. Then the paint step is repeated prior to application of the oil coat. This additional paint coat step is often required because of the tendency for the newly painted parts to adhere to one another during the baking step. After the parts are baked, any parts adhered to one another must be physically separated. However, often the paint coat is also pulled away from one of the parts at the point of engagement, resulting in exposing an unpainted surface area. To combat this problem, a second painting step is employed which tends to assure coverage of most of these exposed surfaces. Without this second painting step, the percentage of failed parts is often too high to acceptably meet automotive specifications for corrosion resistance.

SUMMARY OF INVENTION

The present invention relates to a novel and improved method of treating metal parts and a novel oil and paint coating formulation for use in the method to provide improved corrosion resistance in a more efficient manner.

The novel method and coating formulation provides a combined paint and oil formulation which is applied in a single coating step in place of the two or three steps used in the prior art process. The novel formulation in accordance with the present invention comprises a di-phase composition of a conventional paint composition and an oil component which will not form a solution or stable emulsion with the paint.

The one step coating method in accordance with the present invention involves coating the metal parts with the composition of the present invention when the composition is in a dispersed state wherein the oil component is thoroughly dispersed throughout the paint but retains its character as a separate phase from the paint.

After the coating has been applied in this manner, it is baked to cure the paint coat. This procedure results in the paint coat being deposited against the metal surface and the oil component rising to the surface of the paint coat.

Salt spray tests in accordance with industry standards have shown that the one step coating process of the present invention, in the most preferred embodiment, provides up to two to three times better results in salt spray corrosion resistance tests compared to the prior art while eliminating at least one costly and time consuming step from the processing of such parts.

Tests indicate that the formulation and method of the present invention works well using conventional well-known paint compositions and commercially available oil formulations and that many combinations of various resin film forming paints and oils may be formulated to meet the requirements of a given application. However, the formulation must remain an essentially di-phase composition wherein the oil component does not solubilize or become a stable emulsion in the paint vehicle.

OBJECTS

It is therefore a primary object to provide a novel formulation and method for a single step coating application for treating metal parts for corrosion resistance to salt spray.

It is another object of the present invention to provide a paint-oil formulation and method as described wherein the treated metal parts equal or exceed the corrosion resistance of metal parts processed by the prior art multiple step processes of applying a paint coat and an oil coat to the parts in separate and distinct steps.

It is another object of the present invention to provide a novel paint-oil formulation wherein the oil is finely dispersed within the paint to form a temporary suspension therein without being solubilized or forming a stable emulsion with the paint vehicle.

It is a further object of the present invention to provide a method of applying both a paint and an oil coating to metal parts in a one step application wherein the paint will be deposited upon the surface of the metal part and the oil component separates to be deposited upon the surface of paint coat.

It is yet another object of the present invention to provide a novel and improved formulation and method of treating metal parts for corrosion resistance in a salt spray atmosphere wherein the adherence of the coated metal parts to one another, such as occured in the prior art process, is essentially eliminated.

Further objects and advantages of the present invention will be apparent from the following description, reference being had to the accompanying examples wherein preferred forms of embodiments of the invention are clearly described.

DETAILED DESCRIPTION

In accordance with the present invention, the novel paint-oil composition generally comprises a conventional paint and an oil component which is not coupled into solution in the paint nor which forms a stable emulsion with the paint. Typical conventional paint formulations used for applying paint coats to metal parts for corrosion resistance are useful in the present invention and include those resin film formers such as the epoxy-ester, alkyd melamine, melamine, acrylic and baking enamel types, for example.

The oil component of the di-phase coating composition of the present invention may comprises one of the typical, well-known long chain aliphatic or cycloaliphatic oils used for corrosion resistant coatings in prior conventional methods, such as for example, castor oil, tung oil, linseed oil, mineral oil, naphthenic oils, etc. Also included are the water-displacing, rust inhibiting parafinic oils which are hydrophobic in character. These are typically commercially available products and are presently used for oil coating in the prior art corrosion resistance processing. The first mentioned type comprise aqueous solutions or emulsions of the oils which contain stabilizers, emulsifying agents, and other additives. Typical products of this nature are available under various trademarks and tradenames, such as NAPREX from Mobil Oil and TECTYL from Ashland Petroleum Company, for example. A typical water-displacing oil commercially available from Texo Corporation under the trademark GLOBRITE 364 is an example of the second mentioned type of a parafinic oil.

The water soluble or emulsifiable oils can be enhanced in their ability to provide salt spray corrosion resistance in a manner such as described in U.S. Pat. No. 4,440,582 by suitable compositions which include siloxanes. The disclosures contained therein are hereby incorporated by reference. One of the preferred oil components for use in accordance with the present invention are compositions including one of the above-described oils with siloxanes such as described in U.S. Pat. No. 4,440,582. One such product is commercially available from Ashland Petroleum Company under the trademark TECTYL 603. Another preferred oil formulation for use in accordance with the present invention is a non-aqueous solution of a parafinic oil with a siloxane formulated such as described in Example V which follows later herein.

The siloxanes, as known to those skilled in the prior art to which the invention pertains, are generally prepared by the condensation of silanes to form the characteristic (Si-O-Si) bond. Siloxanes which are useful in the present invention are disclosed in detail in U.S. Pat. No. 4,440,582 and include the polyalklysiloxanes and the alklypolysiloxanes as well as mixtures thereof. The preferred siloxanes disclosed therein are polyalkylsiloxanes wherein the alkyl radical has about one to four carbon atoms and mixtures thereof.

The most preferred siloxanes are the aminofunctional polyalkylsiloxanes. These are commercially available products such as those sold by Dow Corning under the names DOW CORNING 531 and DOW CORNING 536. Also these aminofunctional polysiloxanes can be enhanced relative to corrosion resistance properties by reaction with a fatty acid. The preferred acid reaction used is the siloxane reacted with a fatty acid such as an isostearic acid or an oleic acid, for example.

The paint/oil composition of the present invention will form two separate phases easily visible as layers under static conditions. Mixtures thereof may range from about 50% to 90% by volume of the paint component and 10% to 50% by volume of the oil component. A preferred composition comprises 50% to 70% of the paint and 30% to 50% of the oil component on a volume basis.

The important factor in accordance with the present invention is to assure that the oil and paint components are not soluble in one another nor form a stable emulsion within one another. However, the two separate phases must be sufficiently dispersed within one another to form a temporary suspension of the two phases when applied to the metal part to obtain good results in the context of the present invention. For example, such a temporary suspension as contemplated for use in the present invention will separate upon standing in ambient conditions in about 1 to 24 hours to form two distinct layered phases.

The surprising discovery in accordance with the present invention relates to the necessary di-phase or two phase formulation, which when applied to the metal part in a dispersed form but retaining their separate characteristics, will separate from one another during the drying or baking step to form two distinct coatings. The paint coat adheres to the metal surface and the oil coat essentially is distributed over the surface of the paint coat.

If the oil component becomes an integral part of the paint vehicle such as not to form a separate phase, the parts do not exhibit the high degree of corrosion resistance in accordance with the present invention.

The di-phase composition of the present invention may be advantageously applied by a conventional and well-known dip spin method although other well-known conventional application techniques may be used without departing from the spirit of the present invention.

It has been found that the best results are obtained by properly preparing the parts by the well-known conventional cleaning, and phosphating steps typically employed in the treatment for salt spray corrosion resistance.

During application of the paint-oil formulation in accordance with the present invention, good conventionally accepted painting practices should be followed to obtain the best results.

Metal parts treated with the novel paint-oil formulation in accordance with the method of the present invention have shown surprisingly excellent corrosion resistance relative to industry standard salt spray tests. The preferred compositions and method have exceeded the current minimum industry standard by as much as 300 percent. This represents an improvement of two to three times greater than the prior conventional methods which require two or more coating application steps.

Corrosion resistance test results indicate that corrosion resistance increases with an increase of the oil component in the di-phase formulation up to approximately 30 to 40% of the composition. Further increases beyond 50%, for example, in the percentage of the oil component in the formulation do not appear to significantly increase corrosion resistance.

The following examples illustrate the efficiency of the present invention relative to the treated parts meeting current automotive manufacturing specifications which require painted parts to surpass a 240 hour salt spray test.

EXAMPLE I

A number of steel fastener parts were conventionally prepared by cleaning, alkaline descale, pickled, blackened and phosphated in an essentially identical manner as used in conventional prior art processes. After a rinse and seal, the parts were dried at 220 degrees F. (part temperature) for 5 to 10 minutes to remove surface water.

The parts were then cooled to ambient room temperature. Then the parts were immersed in a di-phase paint-oil composition, as described below, and subjected to a conventional dip-spin step for 15 seconds each in opposing directions. The paint-oil composition had a viscosity of 40–50 seconds #2 Zahn Cup at a temperature of 75 degrees F. The pH of the composition was adjusted to between 8.5 to 9.5 prior to immersing the parts.

After the dip-spin immersion step, the coated parts were dried at 220 degrees F. for 15 minutes.

The paint-oil composition used was formulated using a conventional water based epoxy ester resin paint composition containing black pigment. Such a paint is conventional and is commercially available from Saran Protective Coating Company under the tradename SARAN BWP 9012.

The oil component used was a commerically available oil/siloxane composition sold by Ashland Petroleum Company under the trademark TECTYL 603.

The above paint and oil components were used to make a paint-oil composition comprising 50% paint, 40% oil component, and 10% water. A coating bath of this formulation was prepared and stirred to thoroughly disperse the separate paint and oil components within one another to form a substantially homogeneous temporary suspension. The metal parts referred to above were coated with this formulation by means of a conventional dip-spin technique as described above.

Next the parts were placed in a salt spray atmosphere in accordance with industry standard practices for salt spray corrosion resistance tests pursuant to ASTM Method B 117. The parts showed no signs of rust after 864 hours of exposure to the salt spray atmosphere. The current minimum specification for the automotive industry is exposure for 240 hours without showing any significant signs of visible rust.

EXAMPLE II

A set of metal parts comprising lock nuts were prepared in the same manner as described in Example I and coated with a di-phase composition employing the same steps as described in Example I. However, an aluminum pigmented paint commercially available from Jamestown Paint and Varnish Company under the tradename Jamestown 44210 was substituted for the SARAN BWP 9012 paint in the di-phase composition.

These parts were subjected to the same salt spray test conditions and showed no sign of significant rust after 1008 hours of exposure.

EXAMPLE III

Example II was repeated using a paint-oil coating formulation having 80% of the Jamestown 44210 aluminum paint and 20% of the oil component on a volume basis. The parts began to show signs of rust after 408 hours of exposure to the salt spray atmosphere.

EXAMPLE IV

Example III was repeated but used a paint-oil coating formulation having 70% of the Jamestown 44210 aluminum paint and 30% of the oil component on a volume basis. The parts did not shown signs of sufficient rust amounting to failure until 504 hours of exposure to the salt spray atmosphere. .

EXAMPLE V

The steps described in Example I were repeated, however, the paint/oil formulation employed comprised a water base black pigmented alkyd paint commercially available from Jamestown Paint and Varnish Company and an oil component which included a siloxane formulation having the following composition:

| Ingredient | % by Weight |
|---|---|
| Kerosene | 90.4 |
| Varamid A7 | 1.0 |
| Dow Corning 536 | 6.0 |
| Down Corning 531 | 2.0 |
| Oleic Acid | 0.6 |

Varamid A7 is a surfactant commercially available from Sherex Corporation.

The above siloxane formulation was blended with a water-displacing parafinic oil commercially available from Texo Corporation under the trademark GLOBRITE 364 in a ratio of 20% of the siloxane formulation to 80% of the oil on a volume basis to form the oil component.

The above oil component was added to the above black alkyd paint in a ratio of 60% paint to 40% oil to formulate the coating composition in accordance with the present invention. The parts were coated in the manner described in Example I and then were tested under the same conditions. All parts successfully passed 528 hours of salt spray exposure.

EXAMPLE VI

The steps described in Example V were repeated, however, the paint-oil formulation was changed. The paint-oil formulation included the GLOBRITE 364 oil without the siloxane formulation and consisted of 60% paint and 40% oil on a volume basis. The parts were tested and successfully passed 360 hours of salt spray exposure.

From the foregoing Examples, it should be readily apparent that the method and formulation of the present invention achieved results which surpassed the present minimum industry requirements of passing 240 hours of exposure to the salt spray atmosphere by a factor ranging from almost two to greater than four in most instances. Further, only a single paint/oil coating application step was necessary compared to at least two and often three coating steps as employed in the prior art. For purposes of the salt spray tests conducted herein, the parts were deemed to pass such tests if no more than 3% of the surface area showed visible signs of red rust.

It is also significant to note that the baking temperature employed to cure the resin forming paint of the di-phase composition disclosed herein should not be higher than the flash point of the oil component to avoid driving the oil component phase from the surface of the cured paint coat.

The viscosity of the dispersed di-phase composition used in accordance with the present invention should be controlled to fall in the range of about 25 to 120 seconds #2 Zahn Cup at 75 degrees F. The preferred viscosity range is between about 40 to 60 seconds #2 Zahn Cup at 75 degrees F. for dip-spin application.

While very good results are obtained employing a conventional dip-spin method of applying the di-phase coating of the present invention, other conventional coating methods, such as dipping, spraying or brushing, may also be used without departing from the spirit of the present invention.

Whatever method of application is employed to apply the coating, it is important to assure that the separate paint and oil component phases are well dispersed when the coating is applied. This may be accomplished by periodic mixing of the formulation to maintain a relatively homogenous dispersion of the separate oil component phase within the paint composition. As the paint is cured, the oil phase forms a separate, evenly distributed coating layer upon the surface of the paint coat.

Further, the parts coated in accordance with the present invention do not tend to adhere to one another during the baking or drying step such as occurs in the prior art. This eliminates the need to physically separate such adhered parts and the resulting loss of the paint coat often caused during such physical separation. This is an important advantage since the creation of such small exposed metal surfaces are very detrimental to improved corrosion resistance.

It should also be pointed out that a clear or colored paint composition other than those described herein may be employed in accordance with the present invention. Such components will form a clear or colored paint film in applications wherein this is deemed desirable.

Further, in view of the discovery that paint/oil formulations in accordance with the present invention separate after simultaneous application, the present invention is not limited by the addition of other components to the oil phase which may add desirable attributes to the oil coating which is deposited upon the surface of the paint coat after the drying step has been completed.

What is claimed is:

1. A method for improving the corrosion resistance of a metal part comprising (a) passivating the metal part with a phosphate solution; (b) coating the passivated metal part with a di-phase coating formulation comprising a mixture (1) an oil component; and (2) a resin film forming paint composition, wherein said oil component is dispersed in said paint composition to form a temporary suspension of the two phases; and (c) curing said paint composition to form a paint film coat adhered to the surface of said part with a distinct coat of said oil component distributed over the surface of the paint film coat.

2. The method defined in claim 1 wherein said oil component includes a solution or stable emulsion consisting essentially of (1) an oil; and (2) an aminofunctional alkylpolysiloxane or aminofunctional polyalkylsiloxane or mixtures thereof.

3. A method of applying a single liquid mixture to metal parts to form a two layered coating on said parts and prevent parts in contact with one another from adhering together when the coating is cured, comprising the steps of: (1) mixing a resin film forming component with an oil component to form a liquid suspension, the components being mixed in the ratio of about 10–50% oil to about 50–90% resin; (2) applying a single coating of the suspension to each part; and (3) curing the single coating of said suspension to form two layers on said metal parts with a layer of resin film adhered to the surface of the parts and an oil layer overlying the resin film layer.

4. The method defined in claim 3 wherein said resin film forming component is one or a combination of two or more taken from a group consisting essentially of epoxy-esters, alkyl melamines, acrylics, melamines and baking enamels.

5. The method defined in claim 3 wherein said oil component comprises a solution or stable emulsion of an oil component and an aminofunctional polyalkysiloxane.

6. The method defined in claim 3 wherein said oil conponent comprises a solution or stable emulsion of an oil and an aminofunctional alkylpolysiloxane.

7. The method defined in claim 3 wherein said oil component comprises a solution or stable emulsion of an oil and a mixture of an aminofunctional alkylpolysiloxane and an aminofunctional polyalkylsiloxane.

8. The method defined in claim 5 wherein said oil is a water soluble or water emulsifiable oil.

9. The method defined in claim 5 wherein said oil is a parafinic, water displacing oil.

* * * * *